US010952523B2

(12) United States Patent
Rich et al.

(10) Patent No.: US 10,952,523 B2
(45) Date of Patent: Mar. 23, 2021

(54) BACKPACK WITH POP UP FRAME

(71) Applicant: Mystery Ranch, Ltd., Bozeman, MT (US)

(72) Inventors: Alexander J. Rich, Bozeman, MT (US); Cameron J. Cook, Bozeman, MT (US); Dana W. Gleason, III, Bozeman, MT (US); Luke Boswell, Bozeman, MT (US)

(73) Assignee: Mystery Ranch, Ltd., Bozeman, MT (US)

( * ) Notice: Subject to any disclaimer, the term of this patent is extended or adjusted under 35 U.S.C. 154(b) by 0 days.

(21) Appl. No.: 16/151,661

(22) Filed: Oct. 4, 2018

(65) Prior Publication Data

US 2020/0107630 A1 Apr. 9, 2020

(51) Int. Cl.

| | |
|---|---|
| ***A45F 3/10*** | (2006.01) |
| ***A45F 3/02*** | (2006.01) |
| *A45F 3/14* | (2006.01) |
| *A45F 3/00* | (2006.01) |
| *A45F 3/08* | (2006.01) |

(52) U.S. Cl.

CPC ..... *A45F 3/10* (2013.01); *A45F 3/02* (2013.01); *A45F 3/08* (2013.01); *A45F 2003/006* (2013.01); *A45F 2003/142* (2013.01)

(58) Field of Classification Search

CPC ..... A45F 2003/006; A45F 2003/142; A45F 3/10; A45F 3/08; A45F 3/02

See application file for complete search history.

(56) References Cited

U.S. PATENT DOCUMENTS

| | | | | |
|---|---|---|---|---|
| 3,563,431 | A * | 2/1971 | Pletz | A45F 3/08 224/262 |
| 4,013,201 | A * | 3/1977 | Potter | A45F 3/047 224/262 |
| 8,348,114 | B2 * | 1/2013 | Gleason, Jr. | A45F 3/08 224/633 |
| 8,795,142 | B2 * | 8/2014 | McClellan | A63B 21/00072 482/104 |
| 9,687,063 | B2 * | 6/2017 | Paduano | A45F 3/08 |
| 10,342,319 | B1 * | 7/2019 | Alabdulkarim | A45F 3/08 |
| 10,383,427 | B1 * | 8/2019 | Walker | A45F 3/08 |

(Continued)

OTHER PUBLICATIONS

International Search Report and Written Opinion for PCT/US2019/049654 dated Oct. 8, 2019.

*Primary Examiner* — Derek J Battisti
(74) *Attorney, Agent, or Firm* — Husch Blackwell LLP

(57) ABSTRACT

A backpack system is provided including an external frame, and a separate pack bag. The external frame may include at least one adjustable pole member, wherein the at least one adjustable pole member has a height that is adjustable between a daypack position and an extended position, wherein the extended position is higher than the daypack position. The pack bag can have an adjustable height so that it can be configured complementary to the height of the adjustable pole members. The backpack system may include a sling configured for extending between the frame and pack bag providing a space between the frame and pack bag for accommodating heavy or bulky cargo therebetween. The sling can be extended or retracted in order to selectively adjust the distance between the pack bag and frame.

19 Claims, 6 Drawing Sheets

(56) References Cited

U.S. PATENT DOCUMENTS

| | | | | |
|---|---|---|---|---|
| 2002/0023937 | A1* | 2/2002 | O'Hare | A45F 3/08 224/155 |
| 2007/0262103 | A1* | 11/2007 | Blakley | A45B 11/02 224/190 |
| 2009/0127299 | A1* | 5/2009 | Jamlang | A45F 3/10 224/153 |
| 2010/0032464 | A1* | 2/2010 | Gleason, Jr. | A45F 3/08 224/631 |
| 2012/0024924 | A1* | 2/2012 | Hexels | A45F 3/08 224/576 |
| 2016/0037895 | A1* | 2/2016 | Humphreys | A45F 3/08 224/633 |
| 2016/0316895 | A1* | 11/2016 | Roque | A45F 3/08 |
| 2017/0311703 | A1* | 11/2017 | Wistrand | A45F 3/08 |
| 2018/0271262 | A1* | 9/2018 | Hoge | A45F 3/08 |

* cited by examiner

BACKPACK WITH POP UP FRAME

BACKGROUND OF THE INVENTION

Backpacks have been used for many years to carry a given load of contents on the back of a user. Modern backpacks designed and configured to carry moderate to large loads usually fall into one of two categories: external frame backpacks and internal frame backpacks. External frame backpacks normally include a rigid frame with shoulder straps and a pack bag connected directly to that frame.

In certain situations, like hunting or military applications, backpack users may have only the need to carry in a few items needed for a day adventure. However, when hunting, if the hunter is successful, then they may have to carry out heavy, oversized or awkwardly shaped objects—namely the harvested animal or portions thereof. It is known to have large packs which can be adapted to expand outwardly to allow for carrying of heavy, oversized or awkwardly shaped objects for a variety of applications such as the packs described in U.S. Pat. No. 8,348,114. However, for hunters who are traversing difficult terrain, such as the mountainous terrain, they don't want to carry in a heavy, loaded pack, but they desire to have flexibility to arrange the pack in order to carry out a harvested animal or portions thereof.

Accordingly, a need exists for an expandable backpack system that allows the user to carry a smaller load and smaller profile in one configuration, but also can convert into a pack which allows the user to carry heavy, oversized and awkwardly shaped objects relatively close to the user's back and center of gravity in a stable manner.

SUMMARY OF THE INVENTION

One embodiment of the present invention is directed to a backpack system that includes an external frame with shoulder straps, a pack bag and a sling or shelf extending between a back side of the frame and a front side of the pack bag. In one embodiment, the external frame includes two vertical frame members, and each vertical frame member includes an adjustable support pole. In one embodiment, the adjustable support pole may be moveable between a retracted position and an extended position to allow a user to increase the height of the frame to more easily carry and support heavy, oversized or awkwardly shaped objects. In one embodiment, each vertical frame member includes two pieces operably connected using a shock chord. The two pieces may include mating components of a ferrule so that the two pieces can be connected into a single and continuous vertical support/frame member. In another embodiment, a locking hinge may be implemented to provide folding of the vertical frame member an a lock or latch to secure the two pieces when in the extended position.

In one embodiment, the adjustable support pole may be telescopic and extendable. This may be accomplished by having a first piece of the vertical frame member having an outer diameter that is less than the inner diameter of a second piece of the vertical frame member so that the first piece is received into the second piece and slidable therein. The relative position of the first piece and the second piece can be fixed using a spring-loaded pin, button, or other known connection device.

In one embodiment, the sling/shelf acts as a shelf and permits for space between the frame and pack bag for accommodating cargo therebetween when the sling is in an extended position. The sling can be extended or retracted in order to selectively adjust the distance between the pack bag and frame. In one embodiment, the sling is permanently affixed to a front lower edge of the pack bag and releasably coupled to the frame with straps having adjustable buckles mounted thereon.

Certain embodiments of the invention are outlined above in order that the detailed description thereof may be better understood, and in order that the present contributions to the art may be better appreciated. In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

Other aspects and advantages of the present invention will be apparent from the following detailed description of the preferred embodiments and the accompanying drawing figures.

DESCRIPTION OF THE SEVERAL VIEWS OF THE DRAWINGS

Further features of the present invention will become apparent to those skilled in the art to which the present invention relates from reading the following description with reference to the accompanying drawings, in which.

DETAILED DESCRIPTION OF THE INVENTION

Figure 1:
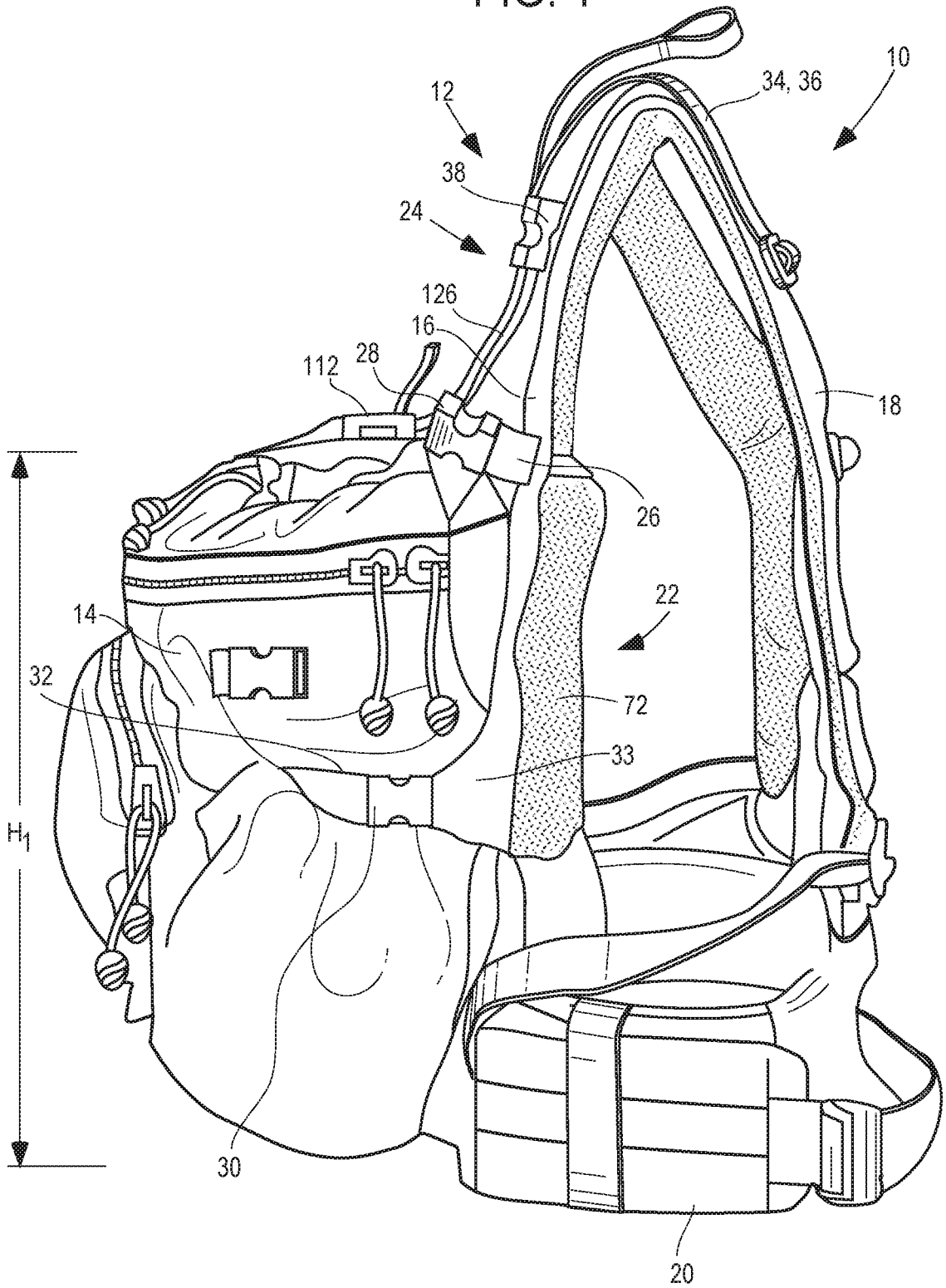
FIG. 1 is a side perspective view of a backpack system in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. The description of the invention will use terms such as vertical, horizontal, top and bottom. These terms are used to describe the components of the backpack system 10 when it is in its normal upright orientation.

One embodiment of the present invention is directed generally to a backpack system 10 comprised of a frame system 12 and pack bag 14. As will be described in further detail below, the pack bag 14 may be mounted to the frame system 12 in a manner that provides flexibility between a "daypack" mode (see FIG. 1) where the pack bag 14 is directly coupled to frame system 12 and an "expanded mode" (see FIGS. 4 and 5) which provides the ability for the backpack system 10 to increase the height of the base frame 16 for providing additional cargo capacity and/or providing a space 124 between the pack bag 14 and frame system 12 for accommodating more cargo, including heavy, oversized or awkwardly shaped objects, therebetween.

Turning to FIG. 1, backpack system 10 is shown in the "daypack" mode wherein the pack bag 14 is secured against the frame system 12. In this embodiment, as can be shown, frame system 12 can be comprised of a base frame 16, shoulder straps 18 and a hip belt 20. The base frame 16 has front side 22 and a back side 24. The shoulder straps 18 and hip belt 20 extend from the front side 22 of the base frame 16.

As further shown in FIG. 1 frame 16 includes a first frame compression strap 26 which is connected to a first bag compression buckle 28, a second bag compression strap 30 which is connected to a second frame compression buckle 32, a first load lifter strap 34, a second load lifter strap 36 (see FIG. 3), wherein each of the first and second load lifter straps 34 and 36 are connected to the bag 14 either directly or indirectly through a load lifter buckle 38. First bag compression strap 26 and buckle 28, and second bag compression strap 30 and buckle 32 may be connected to a wing flap 33 that helps envelop and laterally support pack bag 14 (see FIG. 1) and/or cargo 200 (see FIG. 5) when buckles 28 and 32 are attached to pack bag 14 and straps 26 and 30 are cinched down.

Figure 2:
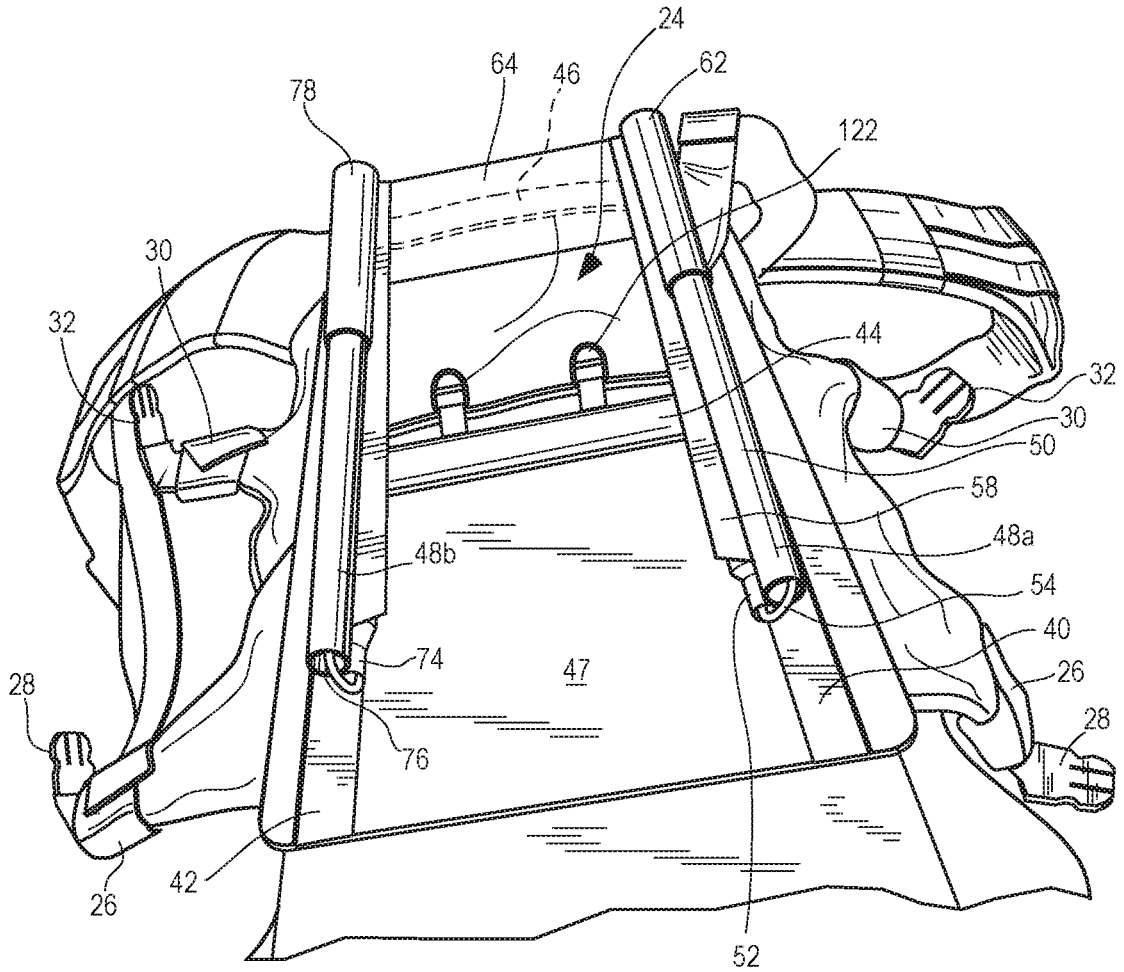
FIG. 2 is a back perspective view of the frame of the backpack system in accordance with one embodiment of the present invention.

As shown in FIG. 2, frame 16 may include a first vertical frame member or stay 40, a second vertical frame member or stay 42, a first horizontal frame member 44, and a second horizontal frame member 46. A fabric or plastic membrane 47 may span between the frame members 40, 42, 44, and 46 to spread the load between the members and connect the members of frame 16. Base frame 16 may include D-rings 122 attached to horizontal frame member 44 (as shown) or, alternatively or in addition, horizontal frame member 46.

As further shown in FIG. 2, the backpack system 10 of the present invention includes at least one vertical frame member adjustable pole 48 that may comprise a first pole member 50 and a second pole member 52 operably connected by a shock cord 54. Shock cord 54 is most effective when it is in a constant tensioned condition. In one embodiment shown in FIG. 2, two adjustable poles 48*a* and 48*b* align with vertical frame members 40 and 42. In one embodiment, shock cord 54 is secured at the outer end 78 of both first pole member 50 and outer end 80 (see FIG. 3) of second pole member 52 and spans between. Adjustable pole 48 can be positioned in a folded or retracted position as shown in FIG. 2, or an extended position (as shown in FIG. 4). In the extended position shown in FIG. 4, inner end 74 of second pole member 52 operably connects with inner end 76 of pole member 50. In the embodiment shown, inner end 74 of second pole member may be ferruled to be received into inner end 76 of pole member 50. In alternative embodiments, either end 74 or 76 may be crimped, ferruled, or otherwise configured to matingly engage with each other. Another embodiment of the invention not shown includes pole members 50 and 52 in a telescoping arrangement so that the outer diameter of one of the pole members is received into the inner diameter of the other pole member and a fastening mechanism is used to fix the relative positions of pole members 50 and 52 in at least two positions corresponding to the above mentioned retracted position and extended position. As shown in FIG. 2, one embodiment includes backpack system 10 having two adjustable poles 48*a* and 48*b*, one on each side of frame system 12 overlaying first and second vertical frame members 40 and 42. Horizontal frame members 44 and 46 span between the two adjustable poles 48*a* and 48*b*.

As shown in FIG. 2, second pole member 52 of adjustable poles 48*a* and 48*b* is secured to frame system 12 with a bottom sleeve 56 (see FIG. 3) and a top sleeve 62, with a backing strap 58 spanning between bottom sleeve 56 and top sleeve 62. Bottom sleeve 56 may be a strip of fabric sewn to frame system 12 along the long sides and the bottom of the strip, or a continuous strip with pockets forming sleeves 56, or otherwise formed sleeve, and may extend substantially along the length of the second pole section 52, may extend either continuously or intermittently along the length of the second pole section 52. In addition, a backing strap 58 spans between the top sleeve 62 and bottom sleeve 56 and may have a length so that backing strap 58 is taut or substantially taut when adjustable poles 48*a* and 48*b* are in an extended position. In one embodiment, backing strap 58 may be folded over like the sections 50 and 52 of adjustable poles 48. This progression is shown in the position of poles 48*a* and 48*b* in FIG. 2 (retracted/daypack position), FIG. 3 (intermediate position), and FIG. 4 (extended position).

As shown in FIG. 4, a top cross member 64 may span between poles 48*a* and 48*b* proximate the top sleeves 62 similar to cross members 44 and 46. As shown in FIG. 4, one embodiment includes two top straps 60 that may extend toward pack bag 14 from either top cross member 64 or top sleeve 62, these straps replace the first and second load lifter straps 34 and 36. Each top strap 60 includes a male load lifter buckle 66 and a top adjustable strap 68, wherein top adjustable strap 68 is coupled to buckle 66 to allow for easy adjustment of the length of top adjustable strap 68. Further, a top load adjuster lock 70 extends off a front side 22 of frame system 14 and may be a female buckle so as to receive load lifter buckle 38 disposed on either first load lifter strap 34 or second load lifter strap 36, each of which has an adjustable length.

Base frame 16 may also include back padding 72 disposed on the front side 22 so as to cushion the carried load comfortably on the back and shoulders of a user.

Figure 6A:
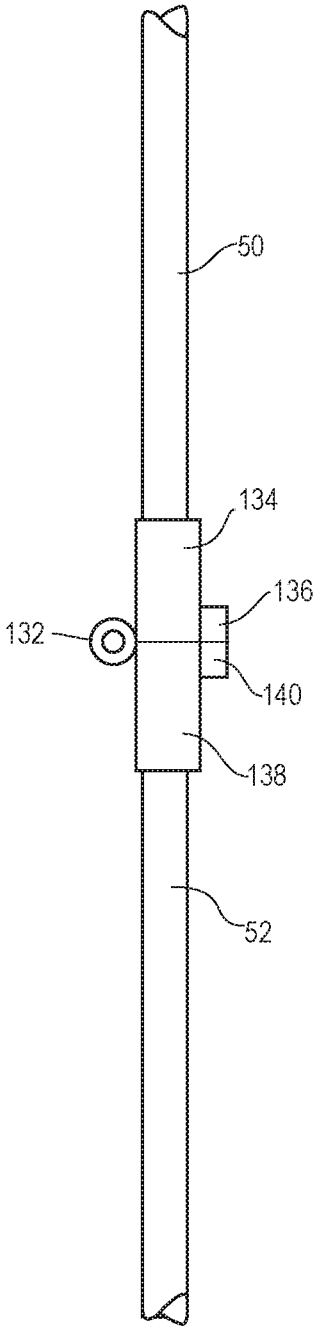
FIG. 6A is a side view of one embodiment of the pole members of the pop-up frame connected with a hinge in accordance with the teachings of the present disclosure shown in an extended position.
Figure 6B:
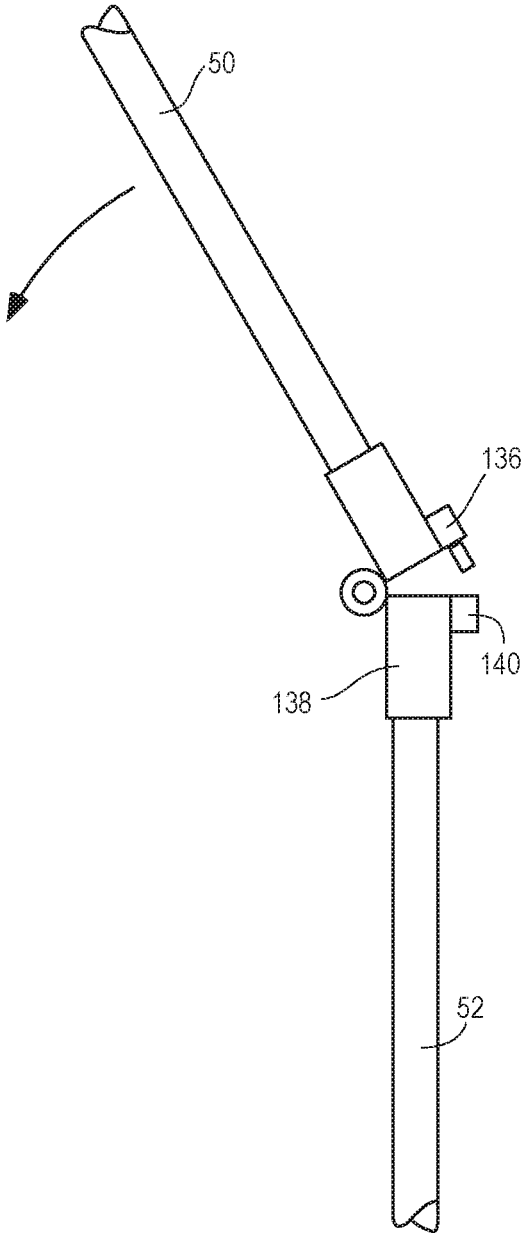
FIG. 6B is a side view of one embodiment of the pole members of FIG. 6A showing the pole member between the extended position and the retracted position.

As shown in FIGS. 6A and 6B, in one embodiment, pole members 50 and 52 may be operably connected with a hinge 130 that may include a locking mechanism 132 to secure the pole members 50 and 52 in an extended position (see FIG. 6A) and then the locking mechanism 132 can be released so as to allow pole members 50 and 52 to fold relative to each other (see FIG. 6B showing the pole members in an intermediate position). In one embodiment the upper hinge portion 134 may include a male buckle 136, and the lower hinge portion 138 may include a female buckle 140 that received the male buckle 136 when pole members 50 and 52 are in the extended position (see FIG. 6A). Male buckle 136 and female buckle 140 comprise locking mechanism 132. A person of skill in the art will appreciate that there are a number of buckles, clasps, clips or other mechanism that allow the upper hinge portion 134 to be releasably secured to lower hinge portion 138 in the extended position. In one embodiment, the locking mechanism 132 or another locking mechanism (not shown) may be included to allow pole members 50 and 52 to be fixed in the retracted position.

Turning back to FIG. 3, which best shows pack bag 14, includes a bag body 90 having a top 92, bottom 94, a front 96, a back 98, a first side 100 (shown facing in FIG. 3), and a second side 102 (not shown, but opposite first side 100). Generally, pack bag 14 may include a front pocket 104, a side pocket 106 on one or both of first side 100 or second side 102, a top opening 108 openable and closeable using a zipper 110. Other pockets may also be included on the side or front outer surface of pack bag 14. Pack bag 14 may have a top opening 108, or a front opening, or any other configuration closeable by zipper 110 or other closing mechanism such as a hook and loop fastener, snaps, buckles or other known closures. One or more top load lifter buckles 112 may be attached to the top 92 of pack bag 14 and, in one embodiment, disposed to receive either load lifter buckle 38 or connected to buckle 38 via an intermediate strap member 126 (as shown in FIG. 1) with the adjustable poles 48*a* and 48*b* in a retracted position, or load lifter buckle 66 extending from strap 68 off of top cross member 64 or top sleeve 62 when adjustable poles 48*a* and 48*b* are in an extended position (see FIG. 5).

Figure 3:
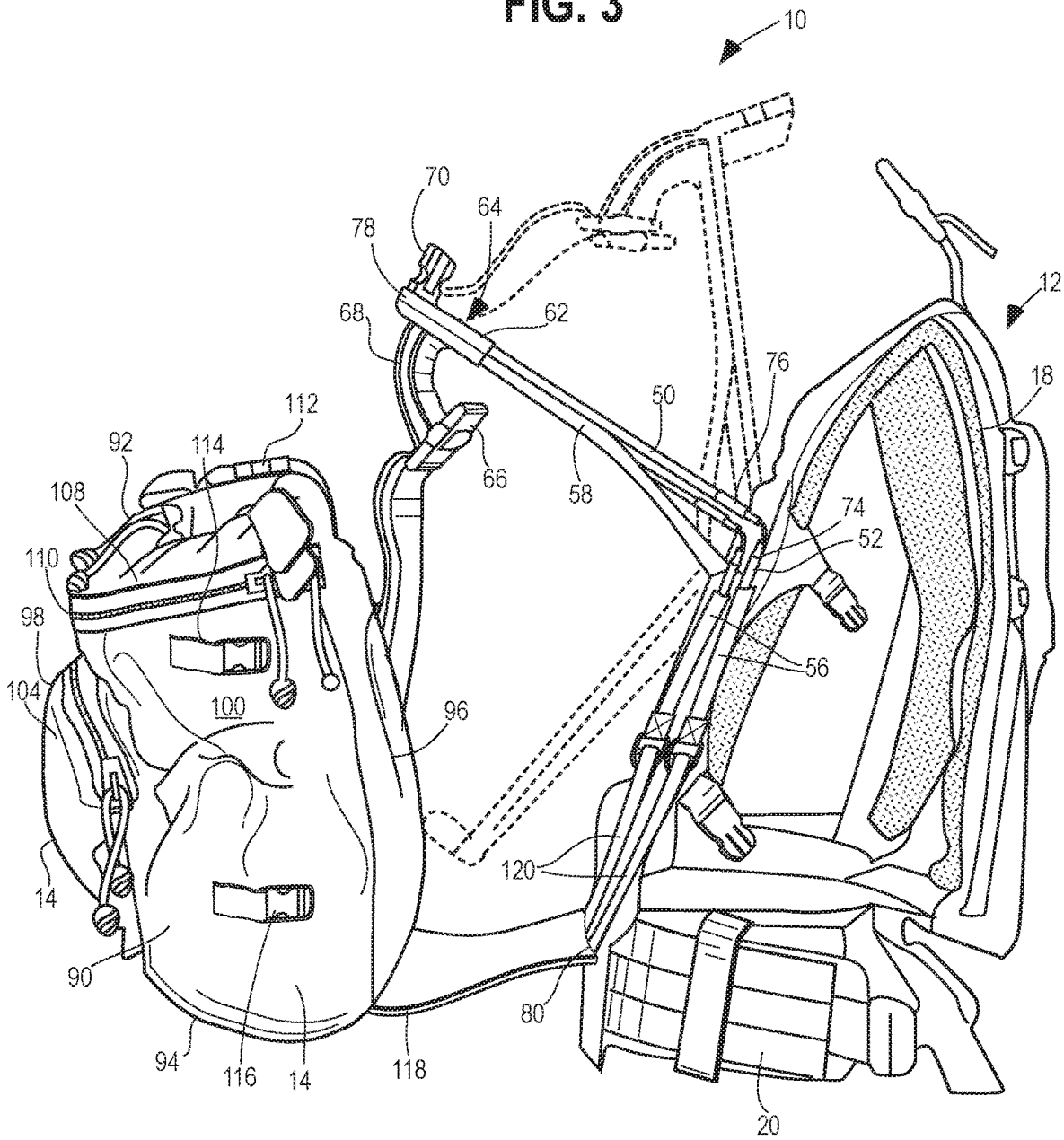
FIG. 3 is a side view of the backpack system in accordance with one embodiment of the present invention showing the pop-up frame in between a retracted position and an extended position.
Figure 4:
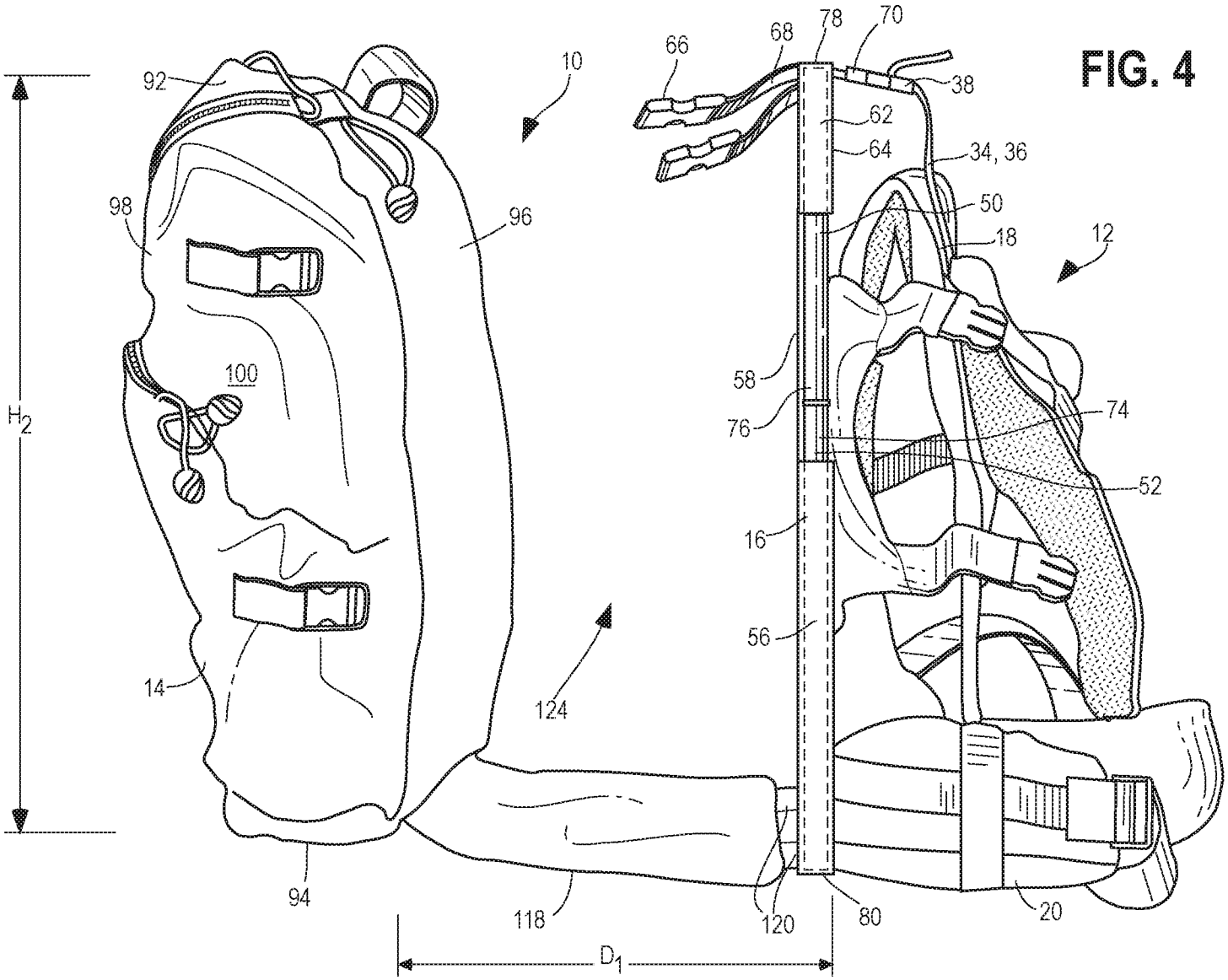
FIG. 4 is a side view of the backpack system of FIG. 3 showing the pop-up frame in an extended position.
Figure 5:
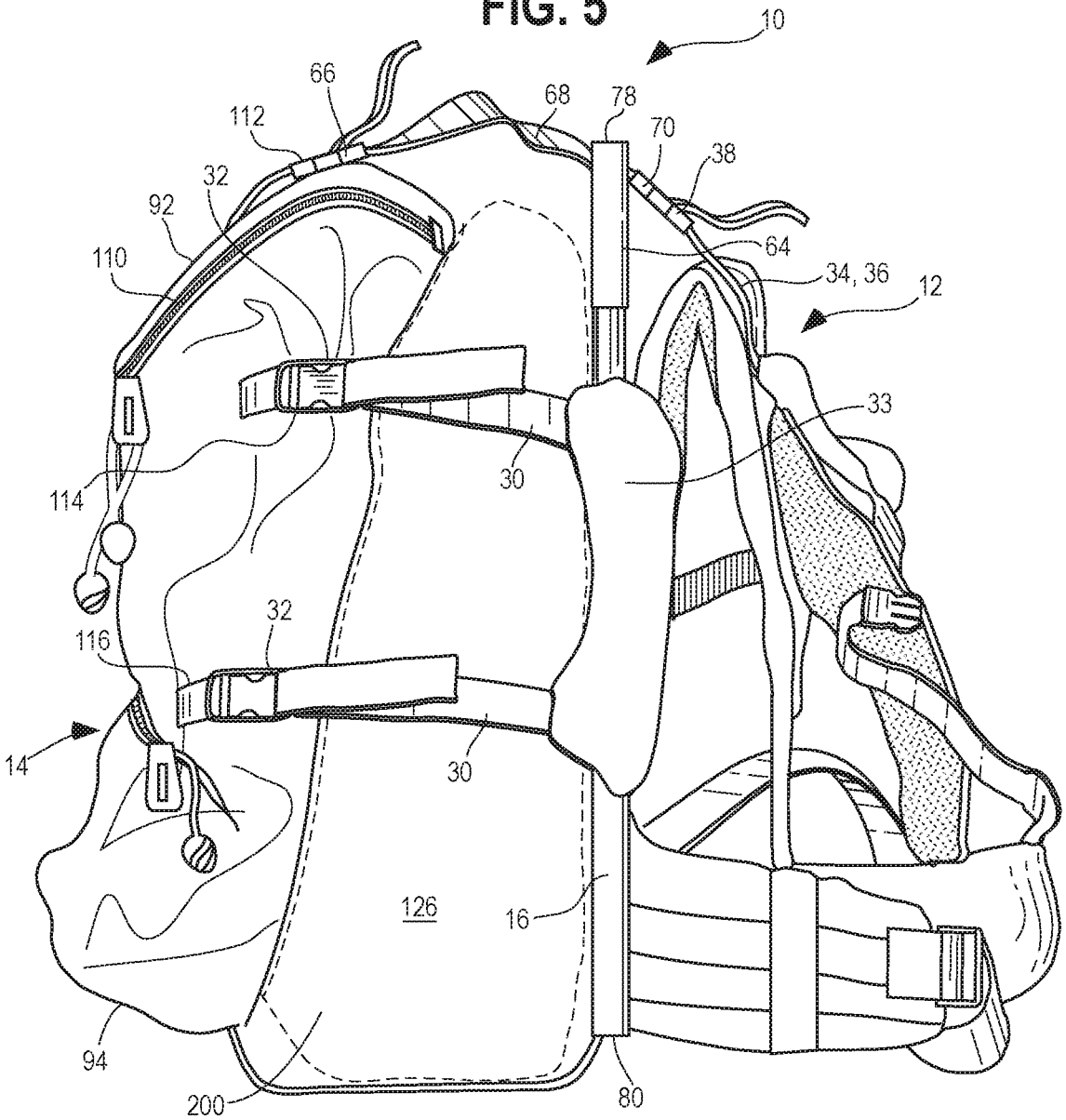
FIG. 5 is a side view of the backpack system of FIG. 3 showing the pop-up frame in an extended position and cargo being secured between the bag and the frame and resting on a shelf in accordance with the teachings of the present disclosure.

As further shown in FIG. 3, pack bag 14 may include a first side buckle 114 and a second side buckle 116 on each side 100 and 102. Further a shelf 118 may extend between pack bag 14 and base frame 16, wherein one or more shelf length adjustment straps 120 may be used to attach shelf 118 to base frame 16 to D-rings 122 that may be coupled to cross member 44 of base frame 16 (see FIG. 2). However, this convention could be reversed, wherein one side of shelf 118 can be attached to base frame 16 and straps 120 can be coupled to pack bag 14 with D-rings or other adjustable fastening mechanism. Shelf 118 may be configured to separate base frame 16 and pack bag 14 by a distance D1 as shown in FIG. 4. Shelf 118 allows the back pack system 10 to be utilized to carry cargo 200, wherein the cargo 200 may be a large, or otherwise awkwardly shaped item, or any other items to be carried by the users. Shelf 118 may also be called a sling, and may be configured in a number of constructions and applications known in the art. Examples of cargo 200 and equipment that can be carried between the pack bag 14 and frame system 12 include tactical radios, ammunition cans, jerry cans, fuel or water canisters, mortar tubes, mortar tube base plates, firearms, tactical or hunting equipment, tents, bags, sleeping bags, humans, animals, dressed or quartered game and any other suitably sized objects, including relatively heavy, oversized or awkwardly-sized objects.

The pack bag 14 can come in a variety of shapes and sizes and can be made from a flexible sheet material (e.g., nylon, polyester or canvas), molded plastic, leather, metal or any other materials known in the art. The pack bag 14 can be similar to pack bags of conventional backpacks. The pack bag 14 may further include a number of sub compartments, pockets, flaps, and partitions as known in the art. The pack bag 14 may be used to carry food, clothing, gear, equipment, supplies and all other items suitably shaped and sized to fit within the pack bag 14. While the pack bag 14 is described herein as a conventional-type bag, it is understood that existing containers such as other packs, boxes, canisters or virtually any suitably sized container or bag can be modified to become a pack bag 14. Additionally, it will be understood that pack bag 14 may be replaced with any number of other objects that are suitable for coupling with the frame system 12.

Pack bag 14 may have a first overall height H1 (see FIG. 1), wherein through one or more compression straps, buckles, zippers, or other mechanisms can be reduced and/or extended to be configured to a second overall height H2 (see FIG. 4).

All of the straps described herein are normally constructed of a durable and fabric-like material, such as nylon or polyester strapping similar to the material frequently used in automobile seatbelts or any other type of material suitable for use in connection with the present invention. The straps may be affixed to the pack bag 14 and base frame 16 by sewing or welding the straps to their respective components or may be removably attached, for example, with hook and loop fasteners. All of the buckles described herein may be quick release buckles comprised of corresponding releasable male and female buckle connectors or any other type of buckle suitable for use in connection with the present invention.

In use, a user may position the backpack system 10 in the daypack mode wherein poles 48*a* and 48*b* are disposed in a folded or retracted position as shown in FIG. 2 and bag 14 is configured for the first height H1. In this mode, a user benefits from a lower profile of the frame 16 and pack bag 14, resulting in a lower center of gravity of the loaded pack.

The convertible nature of the present backpack system 10 is unique in that it can be readily expanded to accommodate carrying of large amounts of cargo and awkwardly shaped cargo. For example, if the user needs more cargo carrying capacity for packing into a base camp, the expanded mode may be utilized with the frame in the extended position and the pack bag extended to H2 connected directly to the frame 16. If the user is a hunter and harvests an elk or a deer, the pack 10 can be adapted to carry portions of the carcass out of the wilderness back to camp and/or transportation. Other civilian and military uses are also envisioned. As shown in FIG. 4, pack bag 14 may be lengthened to height H2 and the backpack system 10 provides a "pop up" portion of the frame system 12 that allows the frame 12 to be converted from its daypack mode into the expanded mode.

As shown in FIGS. 3 and 4, each of the adjustable poles 48*a* and 48*b* may be extended from a daypack position to an extended position by folding over pole section 50 to extend and align with pole section 52. As shown in FIG. 3, this process also unfolds front strap 58 which was folded over. The top sleeve 62, which receives outer end 78 of pole section 50, is attached to front strap 58, thereby allowing the front strap 58 to be taught and to align with and cover poles 48*a* and 48*b*. As shown in FIG. 4, as soon as poles 48*a* and 48*b* are in the extended position, poles 48*a* and 48*b* may be secured to the shoulder straps wherein two top load adjuster lock/buckles 70 at each pole or fastened along cross member 64 is engaged with load lifter buckle 38 of the respective first and second load lifter straps 34 and 36, wherein each shoulder strap 18 includes a load lifter strap 34 or 36, which connects proximate to the outer end 78 of pole section 50. This connection helps secure pole section 50 in the extended position and to stabilize frame system 12.

In the extended position of poles 48*a* and 48*b*, pack bag 14 may be reattached directly to base frame 16 using one or more of side compression straps 26 and 30, and buckles 28 and 32 of base frame 16 to attach to side buckles 114 and 116 on pack bag 14. Compression straps 26 and 30 can be cinched in on each side to secure pack bag 14 to base frame 16. In addition, load lifter strap 68 and buckle 66 may be engaged with two top load lifter buckles 112 disposed on the top 92 of pack bag 14. Again, strap 68 may be cinched in to secure the top 92 of pack bag to base frame 16. This is beneficial, for example, for a multi-day backpacking trip with a base camp, back pack system 12 can be positioned in the extended configuration and used to haul in more cargo for the base camp, such as tents, sleeping bags, and food, so that the user can leave a base camp while day tripping. While day tripping, the present back pack system 12 can be utilized in the daypack orientation shown in FIG. 1.

In the event that the user wants to carry a large and uniquely or awkwardly shaped object that would not very easily be received into the pack bag 14 or otherwise attached to the pack bag 14, the shelf 118 (or sling) can be engaged. The shelf 118 acts as a shelf for supporting cargo positioned between the frame system 12 and pack bag 14. It is one of the other benefits of using adjustable poles 48*a* and 48*b* to convert the pack frame 16 into the extended position (see FIGS. 4 and 5) to accommodate and carry cargo 200. As shown in FIG. 4, shelf 118 may be engaged and the length of shelf straps 120 may be adjusted to adjust the distance D1 between base frame 16 and pack bag 14 that creates a space 124 for accommodating cargo 200 therebetween. In one embodiment, distance D is generally variable between about zero inches and about 12 inches or more; however, other distances could be accommodated. As can be seen in FIG. 4, cargo 200 can most easily be introduced from the top or either side of the back pack system 10 (cargo 200 shown in FIG. 5).

Once cargo 200 is located on shelf 118 and between base frame 16 and pack bag 14, one or more of side compression straps 26 and 30, and buckles 28 and 32 of base frame 16 to attach to side buckles 114 and 116 on pack bag 14. Then compression straps 26 and 30 are cinched in on each side to secure cargo 200 between pack bag 14 and base frame 16. Similarly, load lifter strap 68 and buckle 66 may be engaged with two or more top load lifter buckles 112 disposed on the top 92 of pack bag 14. Again, strap 68 may be cinched to secure cargo between the top 92 of pack bag 14 and base frame 16.

In some embodiments, cargo 200 may be contained in a cargo bag or sack 126, wherein the material of the cargo bag 126 is selected to have some roughness so as to allow some friction between the surface of the front 96 of pack bag 14 and the cargo bag 126, and the cargo bag 126 against the back side 24 of base frame 16 as this will help stabilize the load as it is compressed between the pack bag 14 and base frame 16.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A backpack comprising: an external frame having a front side, a back side, a top and a bottom; at least one shoulder strap extending from the front side of said external frame and operably connected to said external frame; a pack bag having a bag body defined by at least a front side, a back side, a bottom and a top; the external frame comprising at least one adjustable pole being disposed to be selectively positioned at a daypack position at which said frame has a first height and an extended position at which said frame has a second height, wherein said second height is greater than the first height; and a first attachment device extending between and connecting said frame and said pack bag; at least one load lifter strap having a first end operably connected to the at least one shoulder strap and a second end configured for a mating engagement with a first connector disposed proximate the top of the pack bag so that said at least one load lifter strap operably connects the pack bag to the at least one shoulder strap when said at least one adjustable pole is disposed in the daypack position, and wherein said second end of said at least one load lifter strap is capable to be operably connected to said external frame at a second connector proximate the top of said external frame when said at least one adjustable pole is disposed in said extended position; an adjustable shelf member operably coupled to and spanning between said back side of said frame and a front side of said bag body.

2. The backpack of claim 1 wherein said at least one adjustable pole member comprises a first section and a second section, wherein said first section and said second section are pivotably connected so said at least one adjustable pole member can be pivoted between said daypack position and said extended position.

3. The backpack of claim 2 wherein the first section and the second section are operably connected by a shock cord, said shock cord in a tensioned state.

4. The backpack of claim 2 wherein the first section and the second section are operably connected by a locking hinge, wherein said locking hinge includes a locking mechanism to selectively fix the relative position of said first section and said second section in at least the extended position.

5. The backpack of claim 1 further comprising:

the at least one load lifter strap including a first buckle member disposed at the second end and said first buckle member having the shape for a mating engagement with a first connector disposed on the top of the pack bag;

the first connector being a second buckle member coupled to said top of said pack bag; and wherein said first buckle member and said second buckle member are disposed to matingly engage when said at least one adjustable pole member is in the daypack position.

6. The backpack of claim 5 further comprising:

said at least one adjustable pole member including at least a first section and a second section, wherein said first section includes an outer end and an inner end, and wherein said second section includes an inner end and an outer end; and wherein said inner end of said first section is proximate said inner end of said second section when said at least one adjustable pole is disposed in the extended position;

a top sleeve operably connected to said outer end of said second section of said at least one adjustable pole member;

a top strap operably connected to said top sleeve either directly or through a cross member, said top strap comprising a third buckle member; and wherein said top strap is capable to be connected to said pack bag by the mating engagement of the third buckle member and said second buckle member-when said at least one adjustable pole member is in the extended position.

7. The backpack of claim 6, wherein the inner end of the first section and the inner end of the second section are operably connected by a locking hinge, wherein said locking hinge includes a locking mechanism to selectively fix the relative position of said first section and said second section in at least the extended position.

8. The backpack of claim 6, wherein said inner end of said first section and inner end of said second section are pivotably connected so said at least one adjustable pole member can be pivoted between said daypack position and said extended position.

9. A backpack comprising:

an external frame having a front side, a back side, a top and a bottom;

at least one shoulder strap extending from the front side of said frame and operably connected to said frame at a first connection location;

a pack bag having a front side and a top;

the external frame comprising one or more poles capable to selectively position the top of the external frame in at least two operating positions, wherein the first of the at least two operating positions is a daypack position wherein the at least one pole has a first height and wherein the second of the at least two operating positions is an extended position wherein the at least one pole has a second height, wherein said second height is greater than the first height, wherein an upper end of the at least one pole corresponds to the top of the external frame; and a first attachment device extending between and connecting said frame and said pack bag; and at least one load lifter strap operably connected to the at least one shoulder strap and the top of the external frame when the external frame is disposed in the extended position.

10. The backpack of claim 9 wherein said at least one adjustable pole member comprises a first section and a second section, wherein said first section and said second section are pivotably connected so said at least one adjustable pole member can be pivoted between said daypack position and said extended position.

11. The backpack of claim 10 wherein the first section and the second section are operably connected by a shock cord, said shock cord in a tensioned state.

12. The backpack of claim 10 wherein the first section and the second section are operably connected by a locking hinge, wherein said locking hinge includes a locking mechanism to selectively fix the relative position of said first section and said second section in at least the extended position.

13. The backpack of claim 9 wherein said at least one adjustable pole member comprises a first section and a second section, wherein said first section and said second section are disposed in a telescopic relationship so that the first section is received within the second section and slidably moveable therein.

14. The backpack of claim 1 wherein when the at least one adjustable pole of the external frame is in the extended position, a height increase of the external frame between the first height and the second height allows a user to more easily carry and support at least one of a heavier, an oversized and an awkwardly shaped load than when the external frame is in the daypack position.

15. The backpack of claim 1 wherein when the at least one adjustable pole of the external frame is in the extended position, a height increase of the external frame between the first height and the second height allows the frame to provide additional cargo carrying capacity compared to the daypack position.

16. The backpack of claim 1 further comprising at least one wing flap disposed on the external frame to envelop and laterally support one of the pack hag or a piece of cargo.

17. The backpack of claim 9 wherein when the at least one adjustable pole of the external frame is in the extended position, a height increase of the external frame between the first height and the second height allows a user to more easily carry and support at least one of a heavier, an oversized and an awkwardly shaped load than when the external frame is in the daypack position.

18. The backpack of claim 9 wherein when the at least one adjustable pole of the external frame is in the extended position, a height increase of the external frame between the first height and the second height allows the frame to provide additional cargo carrying capacity compared to the daypack position.

19. The backpack of claim 9 further comprising at least one wing flap disposed on the external frame to envelop and laterally support one of the pack bag or a piece of cargo.

* * * * *